US010526842B2

(12) United States Patent
Roberts

(10) Patent No.: US 10,526,842 B2
(45) Date of Patent: Jan. 7, 2020

(54) MOUNTING ARRANGEMENT

(71) Applicant: INFINITY RETRACTABLE SCREENS PTY LTD, Currumbin QLD (AU)

(72) Inventor: Anthony Gerard Roberts, Currumbin (AU)

(73) Assignee: INFINITY RETRACTABLE SCREENS PTY LTD, Currumbin (AU)

( * ) Notice: Subject to any disclaimer, the term of this patent is extended or adjusted under 35 U.S.C. 154(b) by 216 days.

(21) Appl. No.: 15/520,296

(22) PCT Filed: Nov. 26, 2015

(86) PCT No.: PCT/AU2015/000718
§ 371 (c)(1),
(2) Date: Apr. 19, 2017

(87) PCT Pub. No.: WO2016/081983
PCT Pub. Date: Jun. 2, 2016

(65) Prior Publication Data

US 2017/0321479 A1 Nov. 9, 2017

(30) Foreign Application Priority Data

Nov. 26, 2014 (AU) ..... 2014268200

(51) Int. Cl.
*E06B 9/42* (2006.01)
*E06B 9/17* (2006.01)
(Continued)

(52) U.S. Cl.
CPC ..... *E06B 9/42* (2013.01); *E06B 9/1703* (2013.01); *E06B 9/54* (2013.01); *E06B 2009/527* (2013.01)

(58) Field of Classification Search
CPC ..... E06B 9/42; E06B 9/17007; E06B 9/1703; E06B 9/52; E06B 9/54; E06B 2009/527;
(Continued)

(56) References Cited

U.S. PATENT DOCUMENTS 2,574,330 A 11/1951 Judd
3,842,890 A 9/1974 Kramer
(Continued)

FOREIGN PATENT DOCUMENTS

AU 50257/93 5/1994
AU 200154068 B2 1/2002
(Continued)

OTHER PUBLICATIONS

International Search Report dated Apr. 8, 2016 from corresponding International Application No. PCT/AU2015/000718, 5 pages.
(Continued)

*Primary Examiner* — Christopher Garft
(74) *Attorney, Agent, or Firm* — Ohlandt, Greeley, Ruggiero & Perle, L.L.P.

(57) ABSTRACT

A mounting arrangement comprised of a first component for attachment to a support, and a second component supportable by the first component. The first component has a first side which is in use distal from the second component and provides a supporting portion spaced from the first side. The second component provides an engagement portion for engagement with the supporting portion. The mounting arrangement provides a restraining part moveable between a restraining configuration for restraining disengagement of the engagement portion from the supporting portion, and a release configuration for allowing disengagement of the engagement portion from the supporting portion. The mounting arrangement further provides a securing component which is insertable between the second component and
(Continued)

the first side of the first component to restrict disengagement of the engagement portion from the supporting portion.

20 Claims, 8 Drawing Sheets

(51) Int. Cl.
*E06B 9/54* (2006.01)
*E06B 9/52* (2006.01)

(58) Field of Classification Search
CPC . A47H 1/13; A47H 1/14; A47H 1/142; A47H 1/144; A47H 1/104; A47H 1/12; A47H 1/10; A47H 1/18; A47H 1/04
USPC ..... 248/221.11
See application file for complete search history.

(56) References Cited

U.S. PATENT DOCUMENTS 3,911,990 A 9/1975 Hoover et al.
3,916,477 A * 11/1975 Baker, Sr. ..... A47H 1/144 16/94 D
3,927,437 A * 12/1975 Ford ..... A47H 1/144 16/94 R
4,359,081 A 11/1982 Brower
4,475,706 A * 10/1984 Anderson ..... E06B 9/323 16/94 R
4,658,879 A 4/1987 Van Klompenburg
4,802,644 A * 2/1989 Oskam ..... E06B 9/323 160/902
4,821,370 A * 4/1989 Magdars ..... A47H 1/04 16/94 D
4,821,786 A 4/1989 Johnston
4,825,921 A 5/1989 Rigter
4,828,002 A 5/1989 Ashby
4,884,617 A 5/1989 Coenraets
4,949,926 A * 8/1990 Liu ..... E06B 9/323 16/94 R
5,090,468 A 2/1992 Tedeschi
5,121,893 A * 6/1992 King ..... E06B 9/323 160/902
5,111,866 A 12/1992 Prostko
5,186,426 A * 2/1993 Wada ..... E06B 9/323 16/94 R
5,868,191 A 2/1999 Blackmon, Jr.
6,082,432 A 7/2000 Kissinger
6,119,758 A 9/2000 Coenraets
6,186,457 B1 * 2/2001 Carter ..... E06B 9/323 160/166.1
6,322,029 B1 * 11/2001 Sonnenberg ..... E06B 9/323 248/201
6,405,781 B2 6/2002 Davies et al.
6,408,922 B2 6/2002 Desrochers
6,463,983 B1 10/2002 Lang
6,478,070 B2 11/2002 Poppema
6,629,555 B2 10/2003 DeBlock et al.
6,701,994 B2 3/2004 Goldenberg et al.
6,758,503 B2 7/2004 Sadler
6,854,505 B2 2/2005 Grubb et al.
6,899,380 B2 3/2005 Kralik et al.
6,959,748 B2 11/2005 Hudoba
7,017,644 B1 3/2006 Kraeutler
7,100,667 B2 9/2006 Tomita
7,210,513 B2 5/2007 Goldenberg et al.
7,275,581 B2 10/2007 Coenraets
7,367,536 B1 * 5/2008 Anderson ..... A47H 1/144 160/902
7,370,685 B2 5/2008 Moriya et al.
7,487,816 B2 2/2009 Moriya et al.
7,516,771 B2 * 4/2009 Drew ..... E06B 9/323 160/173 R
7,637,302 B2 * 12/2009 Drew ..... E06B 9/323 160/173 R
7,669,634 B2 3/2010 Sugiyama et al.
7,703,500 B2 * 4/2010 Wen ..... E06B 9/323 160/173 R
7,841,377 B2 11/2010 Coenraets
7,861,761 B2 1/2011 Martineau et al.
7,967,052 B2 6/2011 Lin
8,011,413 B2 9/2011 Poppema
8,196,638 B2 6/2012 Roberts et al.
8,371,355 B2 2/2013 Santoro et al.
8,516,728 B2 8/2013 Jung
8,528,623 B2 9/2013 Roberts
8,656,978 B2 2/2014 Goldenberg et al.
8,662,138 B2 3/2014 Komatsu et al.
8,672,014 B2 3/2014 Coenraets
2001/0042346 A1 11/2001 Brioschi
2004/0262470 A1 12/2004 Lowry et al.
2005/0098276 A1 5/2005 Agliolo Quartalaro
2005/0230065 A1 10/2005 Moriya et al.
2005/0252614 A1 * 11/2005 Drew ..... E06B 9/42 160/23.1
2005/0274462 A1 12/2005 Nyffenegger et al.
2006/0289120 A1 12/2006 Pielmeier
2007/0029049 A1 2/2007 Martineau
2009/0057512 A1 3/2009 Garmyn
2009/0229767 A1 9/2009 Mullet
2009/0236050 A1 9/2009 Marzilli
2010/0101739 A1 4/2010 Coenraets
2010/0326605 A1 12/2010 Guillen Chico
2011/0114272 A1 5/2011 Roberts
2012/0061032 A1 3/2012 Snyder et al.
2012/0098301 A1 4/2012 Nakamura et al.
2012/0193045 A1 8/2012 Lin
2014/0041814 A1 2/2014 Roberts
2014/0076507 A1 3/2014 Dibben
2014/0262084 A1 9/2014 Fleischman
2015/0345215 A1 * 12/2015 Roberts ..... E06B 9/42 160/368.1
2015/0361718 A1 12/2015 Hummel
2019/0053654 A1 * 2/2019 Chang ..... A47H 1/14

FOREIGN PATENT DOCUMENTS

AU 201012240 5/2010
AU 2010101509 11/2010
AU 201312350 5/2013
AU 201412734 6/2014
EP 0 119 369 B1 9/1984
JP 2002004753 1/2002
TW 440652 6/2001
WO 9413923 6/1994
WO 2011/111031 9/2011
WO 2012050518 A1 4/2012

OTHER PUBLICATIONS

Written Opinion dated Apr. 8, 2016 from corresponding International Application No. PCT/AU2015/000718, 6 pages.

* cited by examiner

MOUNTING ARRANGEMENT

FIELD

The present disclosure relates to a mounting arrangement and especially, but not exclusively, to a mounting arrangement for mounting a housing for a roller of a blind assembly to a supporting structure.

Definition

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

BACKGROUND

Some arrangements for mounting an object to a supporting structure are known.

In a known arrangement an object is mounted to a supporting structure by provision of fasteners, such as screws, passing through apertures in the object and into the supporting structure.

While such an arrangement can securely and reliably mount the object to the supporting structure, removal and subsequent remounting can be time consuming and inconvenient, especially in particular cases, such as where the object is elongate and multiple screws are used spaced along the length of the object.

Any reference to prior art in this background section is not, and should not be taken as, an acknowledgment or any form of suggestion that the referenced prior art or other background forms part of the common general knowledge anywhere in the world.

SUMMARY OF DISCLOSURE

The inventor of the subject matter disclosed herein has discerned that an improved mounting arrangement is desirable. At least an embodiment of a mounting arrangement in accordance with the present disclosure is intended to allow removal of an object from a supporting structure without the need to remove multiple screws, and to allow subsequent remounting without the need to replace removed screws. At least an embodiment of a mounting arrangement in accordance with the present disclosure is intended to allow removal and subsequent replacement of a housing for a roller of onto which a flexible blind material (which may be, for example a sheet material provided to prevent or reduce passage of light, or provide a barrier to the passage of insects) can be wound or unwound to retract or extend the blind material.

According to a first aspect of the present disclosure there is provided a mounting arrangement comprising:

a first component adapted to be attached to a support; and a second component adapted to be supported by the first component;

wherein the first component has a first side which is distal from the second component when the second component is supported by the first component, and the first component comprises a supporting portion spaced apart from the first side;

wherein the second component comprises at least one engagement portion for engagement with the supporting portion of the first component;

wherein the mounting arrangement comprises a restraining part moveable between a restraining configuration for restraining disengagement of the engagement portion from the supporting portion, and a release configuration for allowing disengagement of the engagement portion from the supporting portion; and wherein the mounting arrangement further comprises a securing component comprising a securing part which is insertable between at least part of the second component and the first side of the first component to restrict movement of the restraining part and thereby restrict disengagement of the engagement portion from the supporting portion.

In an embodiment the restraining part is moveable between a restraining configuration further from the first side of the first component, for restraining disengagement of the engagement portion from the supporting portion, and a release configuration closer to the first side of the first component for allowing disengagement of the engagement portion from the supporting portion.

In an embodiment the securing part is insertable between at least part of the second component and the first side of the first component to restrict movement of the restraining part towards the first side of the first component.

In an embodiment the first and second components are configured so that the engagement portion is engageable with the supporting portion by movement of at least part of the engagement portion away from the first side of the first component, and disengageable from the supporting portion by movement of at least part of the engagement portion towards the first side of the first component.

In an embodiment the restraining part is provided on the engagement portion.

In an embodiment the restraining part is part of the engagement portion.

In an embodiment the first component comprises a supporting projection which provides the supporting portion.

In an embodiment the supporting projection comprises a spacing region which spaces the supporting portion from at least part of the rest of the first component.

In an embodiment the second component comprises an engagement projection which provides the engagement portion.

In an embodiment the engagement projection comprises a spacing region which spaces the engagement portion from at least part of the rest of the second component.

In an embodiment the engagement portion provides an engagement surface, facing generally towards the first side of the first component.

In an embodiment the first component has a second side which is proximal to the second component when the second component is supported by the first component.

In an embodiment the securing part is insertable between the second side of the first component and the first side of the first component to restrict movement of the restraining part towards the first side of the first component.

In an embodiment the securing part is insertable between the second side of the first component and the first side of the first component to restrict movement of the engagement portion towards the first side of the first component.

In an embodiment the securing part is insertable between the restraining part and the first side of the first component to restrict movement of the restraining part towards the first side of the first component.

In an embodiment the securing part is insertable between the restraining part and the first side of the first component to restrict movement of the engagement portion towards the first side of the first component.

In an embodiment the securing part is insertable between the engagement portion and the first side of the first component to restrict movement of the restraining part towards the first side of the first component.

In an embodiment the securing part is insertable between the engagement portion and the first side of the first component to restrict movement of the engagement portion towards the first side of the first component.

In an embodiment the securing part is insertable to substantially prevent movement of the engagement portion towards the first side of the first component.

In an embodiment the engagement portion is adapted to be supported by the supporting portion.

In an embodiment the second component is adapted to be supported at least partially by support of the engagement portion by the supporting portion.

In an embodiment the first component comprises an extrusion.

In an embodiment the first component is elongate and has a length substantially greater than its width.

In an embodiment the first component is substantially uniform in transverse cross section.

In an embodiment the supporting portion is elongate and has a length substantially greater than its width.

In an embodiment the supporting portion is substantially uniform in transverse cross section.

In an embodiment the second component comprises an extrusion.

In an embodiment the second component is elongate and has a length substantially greater than its width.

In an embodiment the second component is substantially uniform in transverse cross section.

In an embodiment the engagement portion is elongate and has a length substantially greater than its width.

In an embodiment the engagement portion is substantially uniform in transverse cross section.

In an embodiment the securing component comprises an extrusion.

In an embodiment the securing component is elongate and has a length substantially greater than its width.

In an embodiment the securing component is substantially uniform in transverse cross section.

In an embodiment the securing part is elongate and has a length substantially greater than its width.

In an embodiment the securing part is substantially uniform in transverse cross section.

In an embodiment the securing part is insertable between at least part of the second component and the first side of the first component by substantially lateral movement of the securing component relative to at least one of the first and second components.

In an embodiment the first and second components are moveable between a configuration in which the engagement portion does not engage the supporting portion, and a configuration in which the engagement portion engages and is supported by the supporting portion, by substantially lateral movement of the second component relative to the first component.

In an embodiment the restraining part is moveable between the restraining configuration and the release configuration by substantially lateral movement of the second component relative to the first component.

In an embodiment there is provided at least one guide surface which guides movement of the restraining part when the second component is moved laterally relative to the first component.

In an embodiment there is provided at least one guide surface on the first component and at least one guide surface on the second component.

In an embodiment the at least one guide surface guides movement of the restraining part towards and/or away from the first side of the first component when the second component is moved laterally relative to the first component.

In an embodiment the at least one guide surface guides movement of the restraining part in a direction which includes a component perpendicular to a length and a width of the first component when the second component is moved laterally relative to the first component.

In an embodiment the restraining part is resiliently mounted on one of the first and second components.

In an embodiment the restraining part is resiliently mounted on the second component.

In an embodiment the restraining part is adapted to resiliently ride over the supporting portion between a coupled configuration of the first and second components and an uncoupled configuration of the first and second components.

In an embodiment the restraining part is adapted to be resiliently biased into a restraining configuration when the first and second components are in the coupled configuration.

In an embodiment the securing part is adapted to secure the restraining part in the restraining configuration, in use.

In an embodiment the restraining part is adapted to be resiliently biased into a recess when the first and second components are in the coupled configuration.

In an embodiment the securing part is adapted to secure the restraining part in the recess, in use.

In an embodiment the second component comprises a component guide surface for engagement with the first component prior to said lateral movement of the second component relative to the first component.

In an embodiment the component guide surface for engagement with the first component comprises an upper surface of the second component.

In an embodiment the component guide surface for engagement with the first component comprises a generally planar surface portion of the second component.

In an embodiment the mounting arrangement is configured so that in use the supporting portion of the first component is adapted to be engaged between the engagement portion and the guide surface of the second component.

In an embodiment the mounting arrangement is configured so that in use the supporting portion of the first component is adapted to be snugly engaged between the engagement portion and the guide surface of the second component.

In an embodiment the mounting arrangement is configured so that in use the securing part is insertable between at least part of the second component and the first side of the first component by substantially lateral movement of the securing part relative to at least one of the first and second components.

In an embodiment the mounting arrangement is configured so that in use the securing part is insertable between at least part of the second component and the first side of the first component by substantially lateral movement of the securing component to at least one of the first and second components.

In an embodiment the second component is adapted to support a housing for a roller.

In an embodiment the second component comprises at least part of a housing for a roller.

In an embodiment the second component comprises at least an upper wall part of a housing for a roller.

According to a second aspect of the present disclosure there is provided a mounting arrangement comprising:

a first component adapted to be attached to a support; and a second component adapted to be supported by the first component;

wherein the first component has a first side which is distal from the second component when the second component is supported by the first component, and a second side which is proximal to the second component when the second component is supported by the first component, and the first component comprises a supporting portion spaced apart from the first side;

wherein the second component comprises at least one engagement portion for engagement with the supporting portion of the first component;

wherein the first and second components are configured so that the engagement portion is moveable into a working position in which it is engaged with the supporting portion, by movement of at least part of the second component substantially linearly in a first direction so that a first part of the engagement portion is engaged with the supporting portion and a further part of the second component is engaged with a retaining portion of the mounting arrangement which prevents or restricts movement of the engagement portion towards the first side of the first component; and wherein the mounting arrangement comprises a securing arrangement for restricting or preventing movement of the engagement portion in a second direction opposite to the first direction.

In an embodiment the movement of at least part of the second component substantially linearly in a first direction comprises movement substantially in a lateral direction relative to the first component.

In an embodiment the movement of at least part of the second component substantially linearly in a first direction comprises movement of the second component substantially in a lateral direction relative to the first component.

According to a third aspect of the present disclosure there is provided a mounting arrangement comprising:

a first component adapted to be attached to a support; and a second component adapted to be supported by the first component;

wherein the first component comprises a supporting portion adapted to be spaced apart from the support;

wherein the second component comprises at least one engagement portion for engagement with the supporting portion of the first component;

wherein the first and second components are configured so that the engagement portion is engageable with the supporting portion by movement of at least part of the engagement portion away from the support, and disengageable from the supporting portion by movement of at least is part of the engagement portion towards the support; and wherein the mounting arrangement further comprises a securing component comprising a securing part which is insertable between at least part of the second component and the support to restrict movement of the engagement portion towards the support and thereby restrict disengagement of the engagement portion from the supporting portion.

In an embodiment the first component comprises a supporting projection which provides the supporting portion.

In an embodiment the supporting projection comprises a spacing region which spaces the supporting portion from at least part of the rest of the first component.

In an embodiment the second component comprises an engagement projection which provides the engagement portion.

In an embodiment the engagement projection comprises a spacing region which spaces the engagement portion from at least part of the rest of the second component.

In an embodiment at least one of the supporting projection and the engagement projection provides at least one shaped guide region to guide engagement of the supporting projection and the engagement projection.

In an embodiment the at least one guide region comprises a bevelled region provided adjacent or as part of the supporting portion or the engagement portion.

In an embodiment the at least one guide region comprises a bevelled region provided adjacent or as part of the supporting portion.

In an embodiment the at least one guide region comprises a bevelled region provided adjacent or as part of the engagement portion.

In an embodiment the supporting portion provides a supporting surface.

In an embodiment the supporting surface has a first side.

In an embodiment the supporting projection provides at least one guide region.

In an embodiment the supporting projection provides a guide region at a first side of the supporting surface.

In an embodiment the supporting projection provides a guide region along a first side of the supporting surface.

In an embodiment the guide region along the first side of the supporting surface is for guiding at least a portion of the engagement portion relative to the supporting surface.

In an embodiment the guide region along the first side of the supporting surface is for guiding at least a portion of the engagement portion relative to the supporting surface to facilitate engagement of the engagement portion with the supporting surface.

In an embodiment the supporting projection provides a guide region at a second side of the supporting surface.

In an embodiment the supporting projection provides a guide region along a second side of the supporting surface.

In an embodiment the guide region along the second side of the supporting surface is for guiding at least a portion of the engagement portion relative to the supporting surface.

In an embodiment the guide region along the second side of the supporting surface is for guiding at least a portion of the engagement portion relative to the supporting surface to facilitate disengagement of the engagement portion with the supporting surface.

In an embodiment the engagement portion provides an engagement surface.

In an embodiment the engagement surface has a first side.

In an embodiment the engagement projection provides at least one guide region.

In an embodiment the engagement projection provides a guide region at a first side of the engagement surface.

In an embodiment the engagement projection provides a guide region along a first side of the engagement surface.

In an embodiment the guide region along the first side of the engagement surface is for guiding at least a portion of the engagement portion relative to the supporting surface.

In an embodiment the guide region along the first side of the engagement surface is for guiding at least a portion of the engagement portion relative to the supporting surface to facilitate engagement of the engagement portion with the supporting surface.

In an embodiment the engagement projection provides a guide region at a second side of the engagement surface.

In an embodiment the engagement projection provides a guide region along a second side of the engagement surface.

In an embodiment the guide region along the second side of the engagement surface is for guiding at least a portion of the engagement portion relative to the supporting surface.

In an embodiment the guide region along the first side of the engagement surface is for guiding at least a portion of the engagement portion relative to the supporting surface to facilitate disengagement of the engagement portion with the supporting surface.

According to a fourth aspect of the present disclosure there is provided a mounting arrangement comprising:

a first component mounted to a support; and a second component releasably mounted on and supported by the first component;

wherein the first component has a first side which is more remote from the second component and a second side which is closer to the second component, and the first component includes a supporting portion spaced apart from the first side, wherein the second component comprises an engagement portion that engages the supporting portion of the first component;

a restraining part moveable between a restraining configuration for restraining disengagement of the engagement portion from the supporting portion, and a release configuration for allowing disengagement of the engagement portion from the supporting portion; and a securing component comprising a securing part which is inserted between at least part of the second component and the first side of the first component to resist movement of the restraining part from the restraining configuration to the release configuration and thereby to resist disengagement of the engagement portion from the supporting portion.

In an embodiment the first component is mounted to a support which comprises a bracket attached to a wall of a building above a window or door opening in the building wall.

In an embodiment the first component is mounted to a support which comprises part of a frame defining an opening.

In an embodiment the first component is mounted to a mounting surface of a support which comprises part of a building which defines a door or window opening of the building, the mounting surface being oriented substantially perpendicular to the plane of the defined opening.

In an embodiment the first component is mounted within a window or door opening of a building.

According to a fifth aspect of the present disclosure there is provided a mounting arrangement comprising:

at least part of a housing; and a mounting arrangement in accordance with any one or more of the first to fourth aspects.

In an embodiment the second component comprises at least part of the housing.

In an embodiment the second component is formed integrally with at least a part of the housing.

In an embodiment the second component is formed integrally with at least a part of the housing as an extrusion.

In an embodiment the housing comprises an upper wall portion.

In an embodiment the upper wall portion is elongate and substantially uniform in transverse cross section.

In an embodiment the upper wall portion is formed as an extrusion.

In an embodiment the second component comprises at least part of the upper wall portion of the housing.

In an embodiment the second component is formed integrally with at least a part of the upper wall portion of the housing.

In an embodiment the second component is formed integrally with at least a part of the upper wall portion of the housing as an extrusion.

In an embodiment the housing comprises a rear wall portion.

In an embodiment the rear wall portion is elongate and substantially uniform in transverse cross section.

In an embodiment the rear wall portion is formed as an extrusion.

In an embodiment the upper wall portion is formed integrally with at least a part of the upper wall portion of the housing.

In an embodiment the upper wall portion is formed integrally with at least a part of the upper wall portion of the housing as an extrusion.

In an embodiment the second component is formed integrally with at least a part of the rear wall portion of the housing.

In an embodiment the second component is formed integrally with at least a part of the rear wall portion of the housing as an extrusion.

In an embodiment the housing comprises a front wall portion.

In an embodiment the front wall portion is elongate and substantially uniform in transverse cross section.

In an embodiment the front wall portion is formed as an extrusion.

In an embodiment the front wall portion is formed separately from the upper wall portion.

In an embodiment the front wall portion is connectable to the upper wall portion in a manner that allows movement of the front wall portion relative to the upper wall portion to allow access to the interior of the housing.

In an embodiment the mounting arrangement is in accordance with one or more of the first, third and fourth aspects, and the securing component is adapted to restrict movement of the front wall portion relative to the upper wall portion.

In an embodiment the housing comprises a lower wall portion.

In an embodiment the lower wall portion is elongate and substantially uniform in transverse cross section.

In an embodiment the lower wall portion is formed as an extrusion.

In an embodiment the lower wall portion is formed integrally with the front wall portion.

In an embodiment the lower wall portion is formed integrally with the front wall portion as an extrusion.

In an embodiment the front wall portion and the lower wall portion together form a continuous curved surface which extends from an upper front region of the housing towards a lower part of the rear wall of the housing.

In an embodiment the housing is a housing for a roller.

In an embodiment the housing is for a roller for a blind.

In an embodiment the housing provides an elongate slot for passage of material forming a blind out of and into an interior of the housing.

In an embodiment the elongate slot is provided between the lower wall portion and the rear wall portion.

In an embodiment the roller is mounted within the housing.

In an embodiment the roller is attached to a sheet of flexible material adapted to act as a blind.

In an embodiment the roller is adapted to rotate in a first rotational direction to wind at least part of the sheet of flexible material thereonto, in order to effect retraction of at least part of the sheet of material into the housing.

In an embodiment the roller is adapted to rotate in a second rotational direction to unwind at least part of the sheet of flexible material therefrom, in order to effect extension of at least part of the sheet of material out of the housing.

In an embodiment the roller is biased in the first rotational direction.

In an embodiment the sheet of material is adapted to restrict passage of light. Thus the blind may be primarily intended to restrict the passage of light through a window opening or the like.

In an embodiment the sheet of material is adapted to restrict passage of insects. Thus the blind may be primarily intended to restrict the passage of insects through a window opening or the like.

It will be appreciated that one or more features described in relation to embodiments of any of the above aspects may be incorporated into embodiments in accordance with any of the other aspects, unless logic dictates otherwise.

BRIEF DESCRIPTION OF THE DRAWINGS

Embodiments will be described below, in detail, with reference to accompanying drawings. The primary purpose of this detailed description is to instruct persons having an interest in the subject matter of the invention how to carry the invention into practical effect. However, it is to be clearly understood that the specific nature of this detailed description does not supersede the generality of the preceding broad description. In the accompanying diagrammatic drawings:

FIGS. 1(*b*) to 1(*d*) illustrate in cross sectional view, sequential stages of assembly of the mounting arrangement of FIG. 1(*a*);

DETAILED DESCRIPTION OF EMBODIMENTS

Figure 1A:
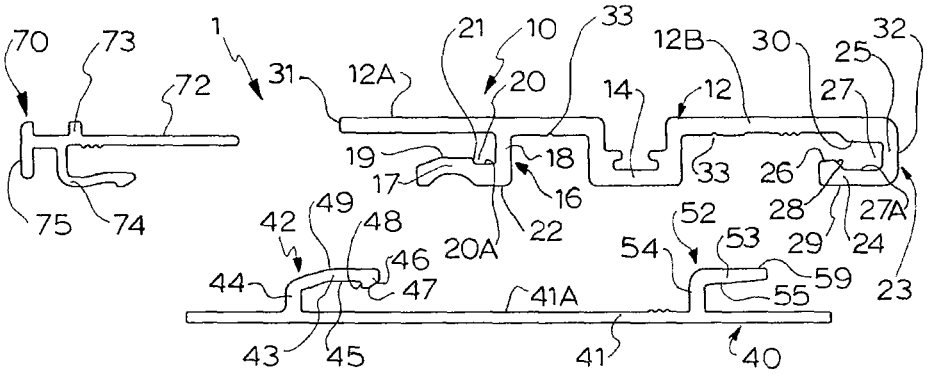
FIG. 1(*a*) illustrates in transverse cross sectional view, a first embodiment of a mounting arrangement in accordance with the present disclosure, comprising three components.
Figure 1B:
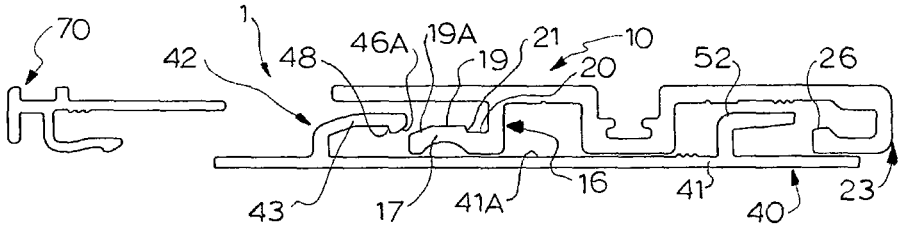
Figure 1C:
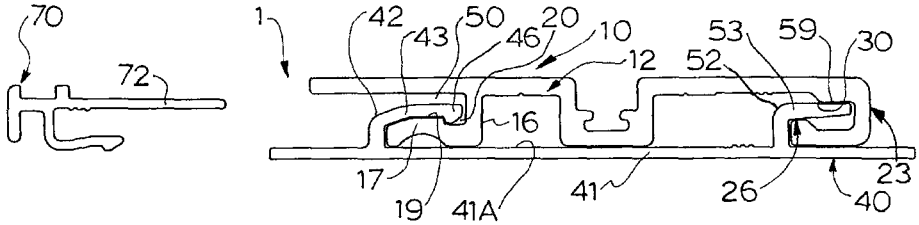
Figure 1D:
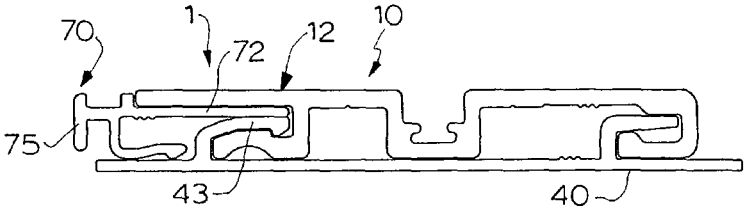

With reference FIGS. 1(*a*) to 1(*d*) an embodiment of a mounting arrangement in accordance with the present disclosure, in the form of a mounting apparatus generally designated 1, will be described.

The mounting apparatus 1 comprises a first component in the form of a first member 10 which is adapted to be attached to a support (not shown in FIG. 1) and a second component in the form of a second member 40 which is adapted to be coupled to and supported by the first member 10. The mounting apparatus 1 further comprises a securing component in the form of a securing member 70.

A primary purpose of the mounting apparatus 1 is to allow an object which is attached to the second member 40, or of which the second member 40 forms a part, to be hung from a support to which the first member 10 is attached so that the object is substantially directly below the support. Accordingly, in FIGS. 1(*a*) to 1(*d*) the second member 40 is illustrated as being substantially directly below the first member 10. Similarly, in other illustrated embodiments, a similar orientation is shown. However, it should be appreciated that the disclosure provided herein is also applicable to mounting arrangements for mounting objects to vertical support surfaces, such as walls, so that the object is mounted to the side of the support. Accordingly, while the illustrated embodiments may be described below with reference to a particular orientation and with reference to terms which depend on orientation (such as top, bottom, or the like), it should be appreciated that other orientations are possible and use of such terms in the detailed description of embodiments should not be read as excluding such other orientations.

As illustrated in FIGS. 1(*a*) to 1(*d*), the first member 10 comprises a top side wall 12. In the illustrated embodiment the top side wall 12 defines a generally planar top side of the first member 10, which may more generally be regarded as an example of a first side of a first component. In the illustrated embodiment the top side wall 12 is divided into first and second generally planar top side wall portions 12A, 12B by a recessed region 14 provided in the top side wall 12.

Depending from the top side wall 12 is a first projection 16 which comprises a supporting portion 17 adapted to be engaged by and to support a part of the second member 40 (as will be described below). The first projection 16 further comprises a spacing portion 18 which couples the supporting portion 17 to the top side wall 12 so that the supporting portion 17 is spaced apart from the top side wall 12. The supporting portion 17 comprises a supporting surface 19 which faces generally towards the top side wall 12, and a recess 20 between the supporting surface 19 and the connection of the supporting portion 17 the spacing portion 18. The recess 20 defines a recess surface 20A which is further from the top side wall 12 than is the supporting surface 19. An inclined or bevelled transition surface 21 provides the transition between the supporting surface 19 and the recess surface 20A. The first projection further provides one or more bottom wall surface portions 22, on the opposite side of the supporting portion 17 to the supporting surface 19.

In this embodiment the spacing portion 18 depends generally perpendicular from the top side wall 12, and the supporting portion 17 depends generally perpendicular from the spacing portion 18.

Further, depending from the top side wall 12 is a second projection 23 which comprises a supporting portion 24 adapted to be engaged by and to support a part of the second member 40 (as will be described below). The second projection 23 further comprises a spacing portion 25 which couples the supporting portion 24 to the top side wall 12 so that the supporting portion 24 is spaced apart from the top side wall 12. The supporting portion 24 comprises a supporting surface 26 which faces generally towards the top side wall 12. The supporting portion 24 comprises a recess 27 between the supporting surface 26 and the connection of the supporting portion 24 and the spacing portion 25. The recess 27 defines a recess surface 27A which is further from the top side wall 12 than is the supporting surface 26. An inclined or bevelled transition surface 28 provides the transition between the supporting surface 26 and the recess surface 27A. The second projection 23 further provides a bottom wall surface portion 29, on the opposite side of the supporting portion 24 to the supporting surface 26.

The first member further provides a contact surface 30 for contacting a part of the second member 40 (as will be described below) which is adjacent to but spaced apart from the supporting surface 26, and generally opposed thereto, so that said part of the second member 40 can be located between, and in contact with, the contact surface 30 and the supporting surface 26.

In this embodiment the spacing portion 25 of the second projection 23 depends generally perpendicular from the top side wall 12, and the supporting portion 24 depends generally perpendicular from the spacing portion 25.

In this embodiment the first projection 16 depends from the first top side wall portion 12A and the second projection 23 depends from the second top side wall portion 12B.

Figure 3:
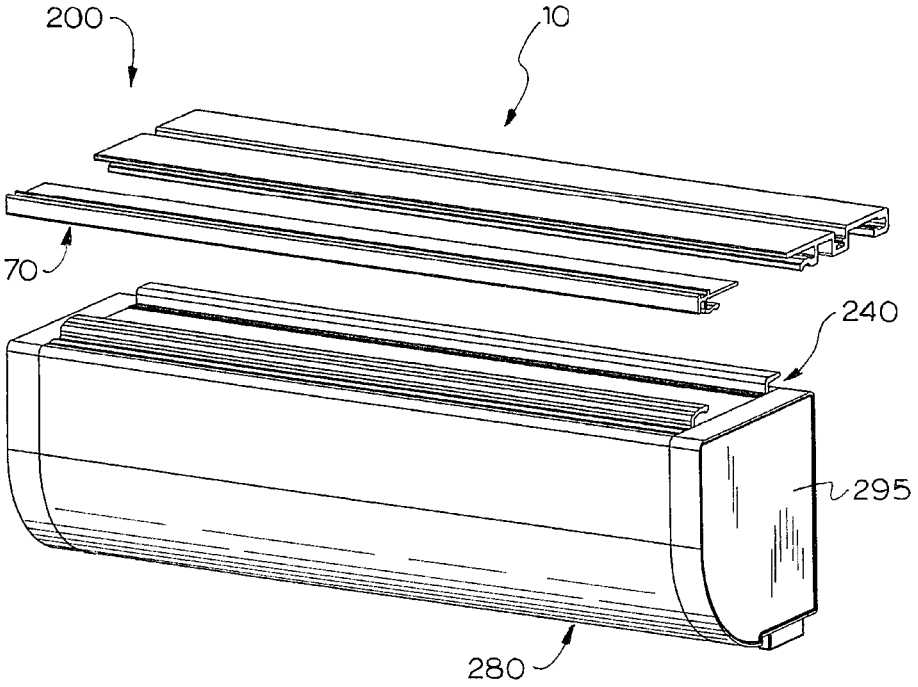
FIG. 3 is a perspective exploded view of an embodiment of a mounting arrangement and housing for a roller consistent with FIGS. 2(*a*) to 2(*c*)

The views of FIGS. 1(*a*) to 1(*d*) are transverse cross sectional views, and may therefore be regarded as showing the shapes of the members 10, 40, 70 across their widths. FIG. 3, which will be described in more detail in due course, provides an illustration of example embodiments of a first member 10 and a securing member 70, and a variation of second member, which will assist in visualising the three dimensional form of these parts.

The members 10, 40, 70 may be of any suitable lengths, as will be described in due course, but it is envisaged that the lengths will normally be greater than their widths. Accordingly the first element 10 may be regarded as providing a first longer edge 31 along a first side of the top side wall portion 12, and a second longer edge 32 along a second side of the top side wall portion 12. In the illustrated embodiment the second longer edge 32 is provided by an exterior wall portion of the spacing portion 25 of the second projection 23.

The top side wall 12 further provides one or more indentations 33, which may be in the form of shallow troughs extending along the length of the first member 10, which may serve to assist in the location of drill bits or fasteners to facilitate fixing of the first member to a support.

In the illustrated embodiment the bottom wall surface portion 22 of the first projection 16, and the bottom wall surface portion 29 of the second projection 23 are generally coplanar, and may be regarded as defining a bottom side of the first member 10. This may be regarded as an example of a second side of a first component of a mounting arrangement.

Figure 2A:
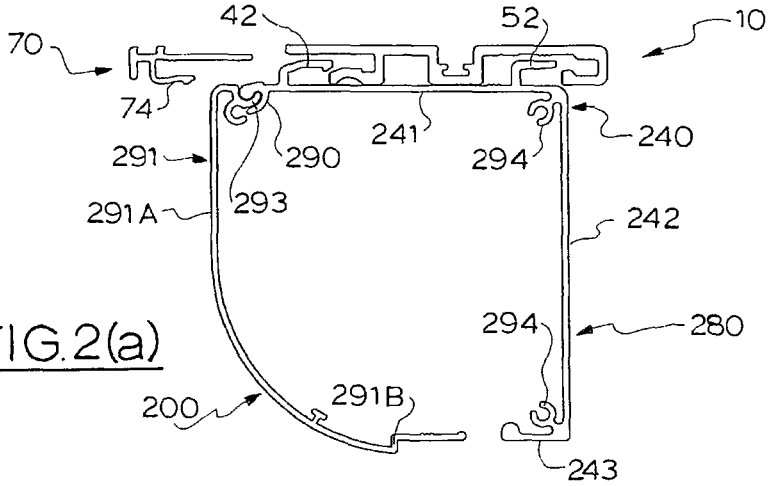
FIGS. 2(*a*) to 2(*c*) illustrate in cross sectional view, sequential stages of assembly of a further embodiment of a mounting arrangement in accordance with the present disclosure in which one of the components is part of a housing for a roller.
Figure 2B:
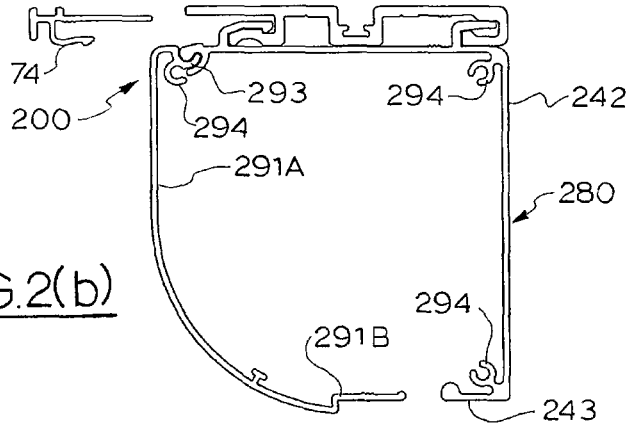
Figure 2C:
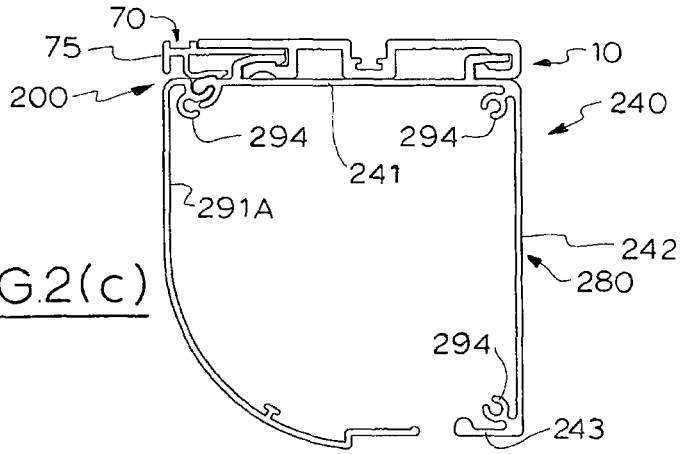

The second member 40 of apparatus 1 comprises a part which it is desired to mount on a support using the first member 10. This is illustrated in FIGS. 1(*a*) to 1(*d*) as being a generally planar wall portion 41, but can be an appropriate part of an object that it is desired to mount, including part of a bracket to which another object can be attached for mounting or, as illustrated in FIGS. 2(*a*) to 4, 7 and 8, part of a housing for a roller for a blind.

The second member 40 comprises a first projection 42 which comprises an engagement portion in the form of engaging portion 43 adapted to engage and to be supported by the supporting portion 17 of the first projection of first member 10.

Depending from the planar wall portion 41 there is provided a spacing portion 44 of the first projection 42, which couples the engaging portion 43 to the wall portion 41 so that the engaging portion 43 is spaced apart from the wall portion 41. The engaging portion 43 comprises an engaging surface 45 which is adapted to engage the supporting surface 19, and a catch portion 46 at the distal end of the engaging portion 43. The catch portion 46 is adapted to be received in the recess 20 of the first projection 16 when the engaging surface 45 engages the supporting surface 19. A catch surface portion 47 of the catch portion 46 may engage the recess surface 20A of the recess 20 when the catch portion 46 is received in the recess 20. The catch portion 46 may comprise an inclined or bevelled transition surface 48 which provides the transition between the catch surface portion 47 and engaging surface 45. The first projection 42 further provides an upper surface portion 49 of the engaging portion 43, on the opposite side of the engaging portion 43 to the engaging surface 45. When the engaging portion 43 is engaged on the supporting portion 17, the upper surface portion 49 of the engaging portion 43 faces generally towards the top side wall 12 of the first member 10, and is spaced apart therefrom so that a space 50 is provided therebetween (see FIG. 1(*c*)). The space 50 allows the catch portion 46 of the engaging portion 43 to ride over the supporting portion 17 when the second member 40 is being coupled to or decoupled from the first member 10, as will be described in more detail hereafter.

The second member 40 comprises a second projection 52 which comprises an engaging portion 53 adapted to engage and to be supported by the supporting portion 24 of the second projection 23 of first member 10.

Depending from the planar wall portion 41 there is provided a spacing portion 54 of the second projection 52, which couples the engaging portion 53 to the wall portion 41 so that the engaging portion 53 is spaced apart from the wall portion 41. The engaging portion 53 comprises an engaging surface 55 which is adapted to engage the supporting surface 26. The second projection 52 further provides an upper surface portion 59 of the engaging portion 53, on the opposite side of the engaging portion 53 to the engaging surface 55. When the engaging portion 53 is engaged on the supporting portion 24 the upper surface portion 59 of the engaging portion 53 faces generally towards the top side wall 12 of the first member 10, and engages the contact surface 30 of the first member 10. Thus when the engaging portion 53 is engaged on the supporting portion 24 (which is achieved by moving the second member laterally—towards the right as illustrated) it is restricted from movement both in the direction towards and the direction away from the top side wall 12.

The apparatus 1 further comprises the securing member 70 which can effectively lock the catch portion 46 of the second member 40 in the recess 20 of the first member 10, thus preventing disengagement of the second member 40 from the first member 10.

In this embodiment the securing member 70 comprises an insertion part 72 for insertion into the space 50 between the engaging portion 43 and the top side wall 12. In this embodiment the insertion part 72 is in the form of a substantially planar plate portion which extends substantially the entire length of the securing member 70 (which may be substantially the same length as the first and second members 10, 40).

In this embodiment the securing member 70 comprises a stop portion 73 adapted to engage the first member 10, and in this embodiment the edge 31 of the first member 10, to limit insertion of the insertion part 72 and provide positive location of the securing member 70 relative to the first and second members 10, 40, in use.

In this embodiment the securing member 70 comprises a projection 74 adapted to engage the second member 40. The projection 74 may be shaped to be complementary to a shaped part of the second member 40. This can assist in providing positive location of the securing member 70 relative to the first and second members 10, 40, in use.

The securing member 70 further comprises a side portion 75, shaped to facilitate manual manipulation of the securing member 70 by a user. In this embodiment the side portion 75 extends perpendicular to and on both sides of (or above and below, as illustrated) the insertion part 72. The side portion 75 may provide a generally rectangular facing panel (see for example FIGS. 2(*c*), 3, 4 and 9) which can assist in providing an attractive appearance to the mounting apparatus 1.

Assembly of the mounting apparatus 1 will be described with reference to FIGS. 1(*a*) to 1(*d*).

As illustrated in FIG. 1(*a*) the first member 10, second member 40 and securing member 70 are not connected. The first member 10 will, in practice, likely be attached to a support (not shown) prior to assembly.

In order to couple the second member 40 to the first member 10 and, thereby, to the support, the second member 40 is brought close to, or into contact with, the first member 10, as illustrated in FIG. 1(*b*), so that the first projection 42 of the second member 40 is adjacent the first projection 16 of the first member 10, and the second projection 52 of the second member 40 is adjacent the second projection 23 of the first member 10.

The second member 40 is then moved, to the right as illustrated in FIGS. 1(*b*) and 1(*c*), so that the engaging portion 43 of the first projection 42 of the second member 40 engages and is supported by the supporting portion 17 of the first projection 16 of the first member 10, and the engaging portion 53 of the second projection 52 of the second member 40 engages and is supported by the supporting surface 26 of the second projection 23 of the first member 10, as illustrated in FIG. 2(*c*). In this position the upper surface portion 59 of the engaging portion 53 is engaged with the contact surface 30. The engaging portion 53 of the second member 40 may be regarded as being located between the supporting portion 24 and the contact surface 30 in a friction fit arrangement.

The first projection 42 of the second member 40 is somewhat resilient, so that during movement of the second member 40 between the positions illustrated in FIGS. 1(*b*) and 1(*c*), the catch portion 46 of the first projection 42 of the second member 40 is able to ride over the upper surface portion 19 of the first projection 16 of the first member 10. As the connected position illustrated in FIG. 1(*c*) is reached the catch portion 46 moves away from the top side wall 12 into the recess 20, guided by the inclined or bevelled transition surfaces 21, 48.

In the embodiment of FIGS. 1(*a*) to 1(*d*), the spacing of the engaging portion 43 from an upper surface 41A of the generally planar wall portion 41 of the second member 40 is substantially the same as the distance between the supporting surface 19 and the bottom wall surface portions 22 of the first projection 16 of the first member 10. Also, in this embodiment, the spacing of the engaging portion 53 from the upper surface 41A of the generally planar wall portion 41 of the second member 40 is substantially the same as the distance between the supporting surface 26 and the bottom wall surface portion 29 of the second projection 23 of the first member 10.

Thus, when the second member 40 is brought into contact with the first member 10, but before coupling, as shown in FIG. 2(*a*), the upper surface 41A of the generally planar wall portion 41 abuts the second side of the first member, preventing further upwards movement of the second member 40 relative to the first member 10. This facilitates the coupling operation by effectively positioning the second member 40 relative to the first member 10 prior to coupling, reducing the likelihood of misalignment by a user. This also means that the movement of the second member 40 laterally relative to the first member 10 is well defined and tightly constrained.

In relation to the engagement of the first projection 42 of the second member 40 with the first member 10, the tightly constrained lateral movement prevents the catch portion 46 from moving across the supporting surface 19 without touching it, requires some deformation of the first projection 42 of the second member 40 in order to allow the catch portion 46 to move across the supporting surface 19, and ensures correct location of the catch portion 46 in the recess 20 when the lateral movement is completed. As shown in FIG. 2(*b*) the catch portion 46 is provided with a bevelled or inclined insertion direction surface 46A and the first projection 16 of the first member is provided with a bevelled or inclined receiving end surface 19A so that lateral movement of the second member (to the right, as illustrated) from the position shown in FIG. 2(*b*) causes the catch portion 46 to move towards the top side wall 12 so that it can ride over the supporting surface 19.

In relation to the engagement of the second projection 52 of the second member 40 with the first member 10, the tightly constrained lateral movement ensures that the engaging portion 53 is correctly aligned, and its movement is in the correct direction, to ensure that it is inserted between the supporting surface 26 and the contact surface 30, as described above.

The close engagement of the supporting portion 17 between the engaging portion 43 and the wall portion 41, and of the supporting portion 24 between the engaging portion 53 and the wall portion 41 may also assist in reducing play (in the vertical direction as illustrated) between the first and second members 10, 40, in the assembled configuration.

In the position illustrated in FIG. 1(*c*) the second member 40 may be regarded as coupled to the first member 10 so that the second member 40 is mounted upon and supported by the first member 10. However, if a substantial force is applied to the second member 40, to the left as illustrated in FIGS. 1(*b*) and 1(*c*), the catch portion 46 of the first projection 42 of the second member 40 may be forced towards top side wall 12 out of the recess 20, guided by the inclined or bevelled transition surfaces 21, 48, and may ride over the upper surface portion 49 of the first projection 16 of the first member 10, leading to decoupling or demounting of the second member 40 from the first member 10.

While deliberate demounting of the second member 40 from the first member 10 may be desirable under some circumstances, inadvertent demounting is undesirable. For example, when the apparatus 1 is used to mount a housing for a roller for a blind to a wall or other support, it is undesirable for pulling on the blind to result in decoupling of the roller housing from the first member and from the wall or other support on which it is mounted.

As illustrated in FIG. 1(*d*) the second member 40 may be 'locked' to the first member 10 by insertion of the insertion part 72 of the securing member 70 into the space 50, that is, between the engaging portion 43 of the second member 40 and the top side wall 12. Such insertion may be achieved by manually pushing the insertion part 72 of the securing member 70 into the space 50. Locating the insertion part 72 of the securing member 70 into the space 50, that is, between the engaging portion 43 of the second member 40 and the top side wall 12, prevents the catch portion 46 of the first projection 42 being forced towards top side wall 12, and retains the catch portion 46 in the recess 20.

It will be appreciated that any movement of the catch portion 46 towards the top side wall 12 will apply a force to the insertion portion 72 towards the top side wall 12, effectively clamping or wedging the insertion portion 72 between the engaging portion 43 and the top side wall 12. This increases resistance of the insertion portion 72 to lateral movement relative to the first and second members 10, 40. Thus even application of a substantial force to the second member 40 will not dislodge the insertion part 72.

While, in this embodiment, no catch portion is provided as part of the second projection 52, it will be appreciated that in use the catch portion of the first projection 42, when 'locked' in place by the securing member 70 will act to prevent lateral movement of the second projection 52 of the second member 40 relative to the second projection 23 and contact surface 30 of the first member 10, so that disengagement of the second projection 52 of the second member 40 from the second projection 23 of the first member 10 is restricted or prevented.

If it is desired to demount the second member 40 from the first member 10, the insertion member 70 may be removed, so that upon application of a suitable force to the second member 40, to the left as illustrated in FIGS. 1(*b*) and 1(*c*), the catch portion 46 will be forced towards top side wall 12 out of the recess 20, guided by the inclined or bevelled transition surfaces 21, 48, and will ride over the supporting surface 19 of the first projection 16 of the first member 10. Simultaneously, the engaging portion 53 will be laterally withdrawn from its position between the supporting portion 24 and the contact surface 30. This allows demounting of the second member 40 from the first member 10.

Subsequently the second member 40 may be remounted to the first member 10, if desired, as described above.

It should be appreciated from the above description that the described functionality is provided by members which have a substantially uniform cross sectional shape, for example as illustrated in FIGS. 1(*a*) to 1(*d*). The members 10, 40, 70 may therefore conveniently be provided by extrusions formed from a suitable material. In a preferred embodiment the extrusions are of metal, for example aluminium.

An advantage of using members which have a substantially uniform cross sectional shape is that the members may be cut to any desired length from supplied stock. Further, longitudinal alignment of the members is not required, as might be the case if the members were provided with complementary catch portions or the like spaced periodically along their lengths.

The described embodiment thus provides a mounting apparatus which allows secure mounting of a second member relative to a first member, but which allows the second member to be demounted from (and, if desired, subsequently remounted to) the first member without requiring operation of a multiplicity of fasteners, such as screws or the like.

FIGS. 2(*a*) to 11 illustrate practical embodiments of variations of the mounting apparatus 1 of FIGS. 1(*a*) to 1(*d*), as applied to the mounting of a housing for a roller for a blind to a wall or other support. Many elements and features of the embodiments of FIGS. 2(*a*) to 11 are the same as or similar to those of the mounting apparatus 1, and accordingly corresponding reference numerals will be used and the description provided in relation to the embodiments of FIGS. 2(*a*) to 11 will focus on the variations and augmentations to the embodiment of mounting apparatus 1 of FIGS. 1(*a*) to 1(*d*), rather than the similarities.

FIGS. 2(*a*) to 2(*c*) illustrate in cross sectional view, sequential stages of assembly of an embodiment of a mounting apparatus 200 in accordance with the present disclosure. The mounting arrangement 200 comprises a first member which may be the same as the first member 10 of the mounting apparatus 1, and which is therefore designated by the reference numeral 10. The mounting apparatus 200 comprises a securing member which may be the same as the securing member 70 of the mounting apparatus 1, and which is therefore designated by the reference numeral 70. The mounting apparatus 200 comprises a second member 240 which differs from the second member 40 of the mounting apparatus 1, in that the second member 240 is part of a housing 280 for a roller of a blind. The housing 280 may be a housing for a roller of a blind which is for use in covering a window (not shown) and which may be, for example, provided to prevent or reduce passage of light, or provide a barrier to the passage of insects.

In this embodiment the second member 240 comprises a wall portion 241 which in use provides a top wall of the housing 280, a first further wall portion 242, which in use provides a rear wall of the housing 280, and a second further wall portion 243, which in use provides part of a bottom wall of the housing 280.

A front edge of the wall portion 241 provides a first part 290 of an attachment arrangement for attachment of a further (in this embodiment curved) wall portion 291 of the housing 280.

In this embodiment the first part 290 of the attachment arrangement provides a shaped portion of the upper surface of the wall portion 241 of the second member 240. As foreshadowed above, the projection 74 of the securing member 70 is shaped to be complementary to this shaped portion, to further assist in firm location of the securing member 70 relative to the first and second members.

The curved wall portion 291 provides a front wall portion 291A of the housing and a bottom wall portion 291B of the housing which terminates spaced apart from the second further wall portion 243 to provide a gap 292 through which material forming a blind (not shown) may exit and enter the housing as the blind is extended and retracted. The top of the front wall portion 291A is provided with a second part 293 of the attachment arrangement, for attachment to the first part 290 of the attachment arrangement. The housing 280 provides interior lugs or connections 294, for attachment of housing end plates. Part of the projection 74 of the securing member 70 may be provided so that in use it can assist in keeping the housing 280 closed. That is, part of the projection 74 may assist in keeping the curved wall portion 291 of the housing 280 in position relative to the wall portion 241 of the second member 240 by engaging or restricting movement of an upper part of the curved wall portion 291, as best seen in FIG. 2(*c*). Removal of the securing member 70 may allow opening of the housing 280, to allow in situ access to the interior of the housing, by pivoting of the curved wall portion 291.

The second member 240 further comprises first and second projections which may be the same as the first and second projections 42, 52 of the second member 40 of the mounting apparatus 1, and which are therefore designated by the reference numerals 42, 52 respectively. The stages of assembly shown in FIGS. 2(*a*) to 2(*c*) correspond to the stages of assembly shown in FIGS. 1(*b*) to 1(*d*) respectively.

FIG. 3 shows a perspective view of the apparatus 200 of FIGS. 2(*a*) to 2(*c*), with the first member 10, second member 240 and securing member 70 spaced apart. As shown in FIG. 3 the housing 280 is provided with at least one housing end plate 295. The perspective view of FIG. 3 should be considered relevant to the disclosure of mounting apparatus 1, as it provides a perspective view of elements shown only in cross section in FIGS. 1(*a*) to 1(*d*).

Figure 4:
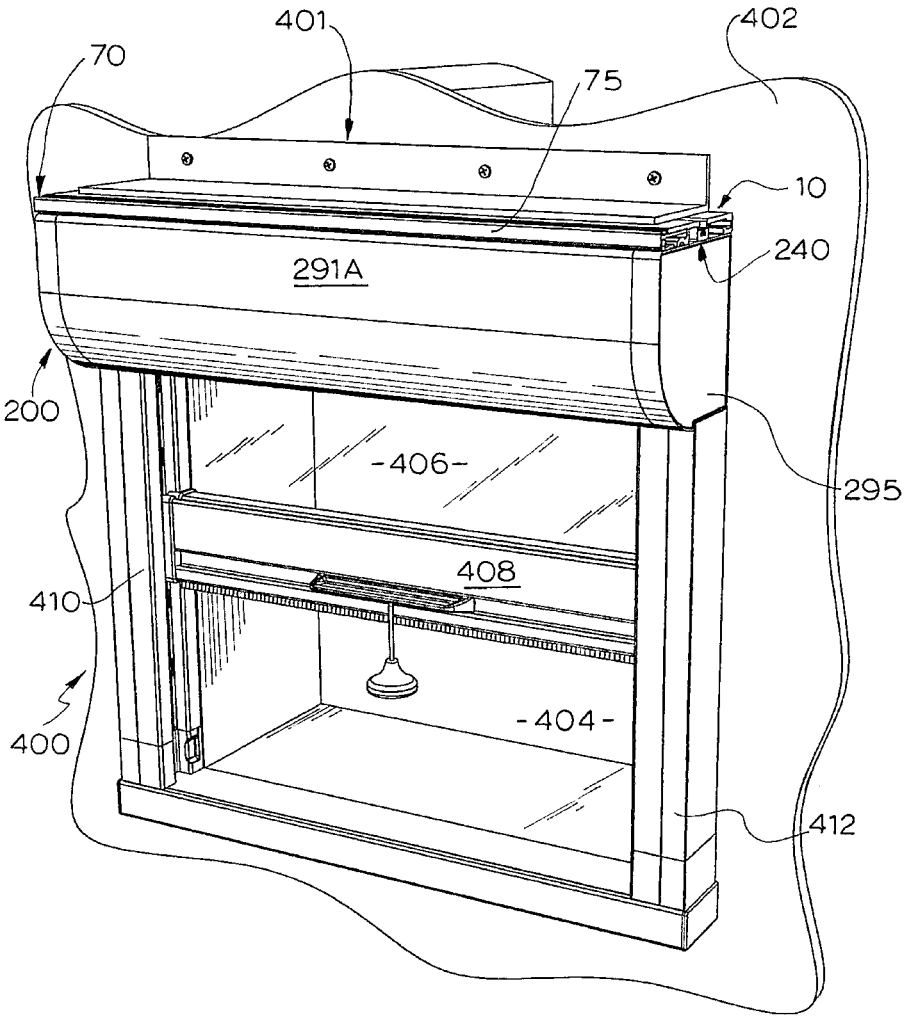
FIG. 4 is an illustration of the mounting arrangement and housing for a roller of FIG. 3 mounted via a bracket to a vertical wall adjacent a window opening.

FIG. 4 shows a perspective view of the apparatus 200 of FIGS. 2(*a*) to 3 in use as part of a blind assembly 400, mounted via a bracket 401 to a vertical wall 402 adjacent a window opening 404. The blind assembly comprises the apparatus 200, a blind roller (not shown) within the housing 280 onto which the blind may be rolled and which may provide a bias force to the blind to aid retraction, a flexible sheet material 406 which forms the blind, a bottom bar 408 which provides a substantially rigid bottom edge of the blind, and guide tracks 410, 412 which guide the edges of the blind in use.

Figure 5:
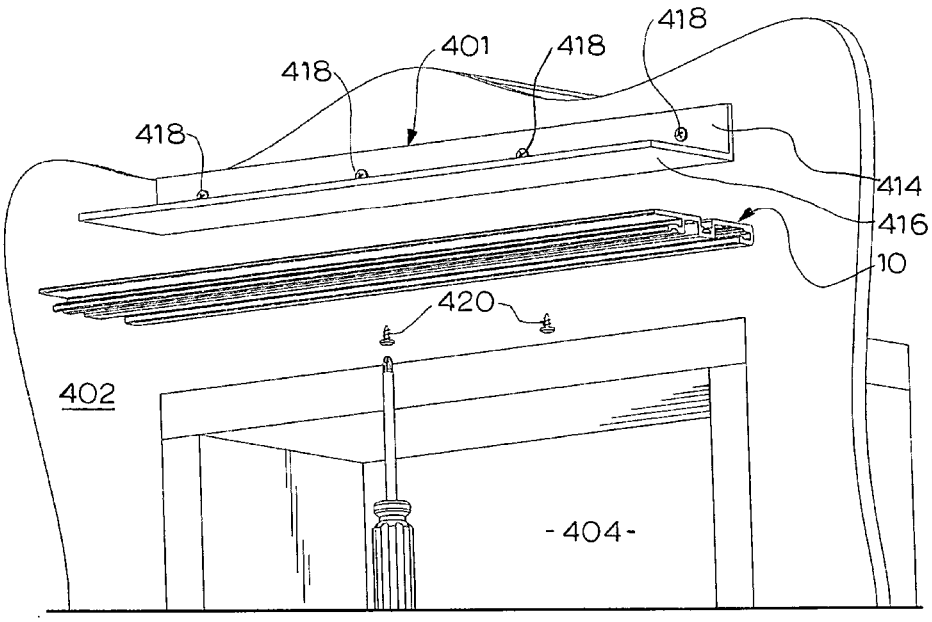
FIGS. 5 and 6 are respectively perspective and side views illustrating attachment of a first component of the mounting arrangement of FIG. 4 to the bracket adjacent the window opening.
Figure 6:
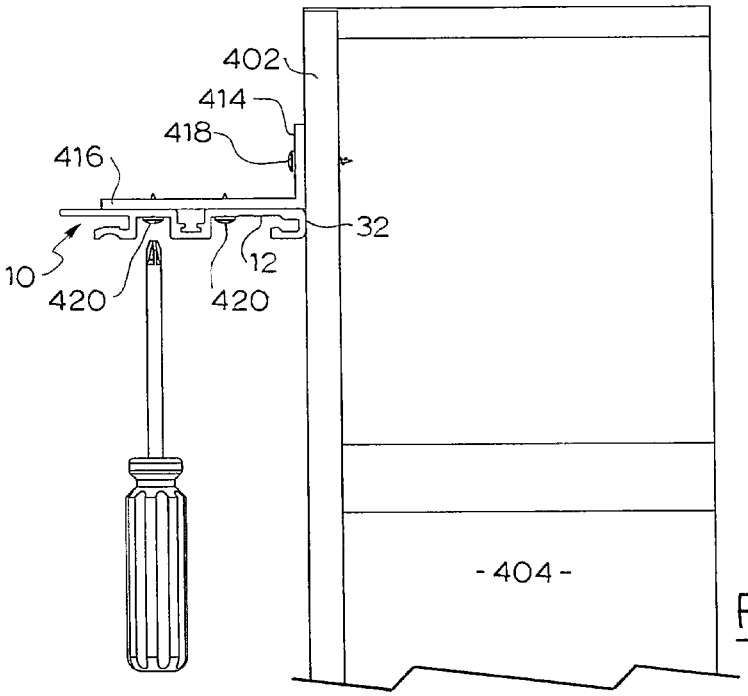

FIGS. 5 and 6 illustrate attachment of the first member 10 to the bracket 401.

The bracket 401 is adapted to be attached to the wall 402 and to provide a substantially horizontal surface to which the first member 10 can be attached.

In the illustrated embodiment the bracket 401 is in the form of an elongate member which is generally L-shaped in transverse cross section.

The bracket has a first portion 414 which is adapted to abut and be attached to a wall 402, and a second portion 416 which projects substantially perpendicular from the first portion 414. In this embodiment the second portion 416 has a width slightly smaller than the width of the first member 10.

The bracket 401 is mounted to the wall 402 above the window opening 404, for example using fasteners such as suitable screws 418 (and associated fixing materials such as wall plugs if desired) in a position such that the housing 280 can be mounted so that at least most of the housing 280 is above the window opening 404. It will be appreciated that the fasters, e.g. screws 418, will be appropriately spaced along the length of the bracket 401.

The first member 10 is attached to the second portion 416 of the bracket 401 for example using fasteners which extend through the top side wall 12 and the second portion 416 of the bracket 401. The fasteners may be suitable screws 420, or other suitable fasteners such as other threaded fasteners, rivets or the like. It will be appreciated that the fasters, e.g. screws 420, will be appropriately spaced along the length of the first member 10. In this embodiment the fasteners are provided in two lines which extend longitudinally along the length of the first member 10. Apertures (not shown) may be made (for example by drilling) in situ or pre-formed in the first member 10, and the second portion 416 of the bracket 401, if necessary, to facilitate extension of the fasteners therethrough. The indentations 33 may be used to assist provision of the apertures (for example, by assisting positioning of a drill bit) and/or positioning of the fasteners.

The first member 10 is preferably positioned so that it abuts the wall 402. The first member 10 is preferably positioned so that the second longer edge 32 thereof abuts the wall 402.

Figure 7:
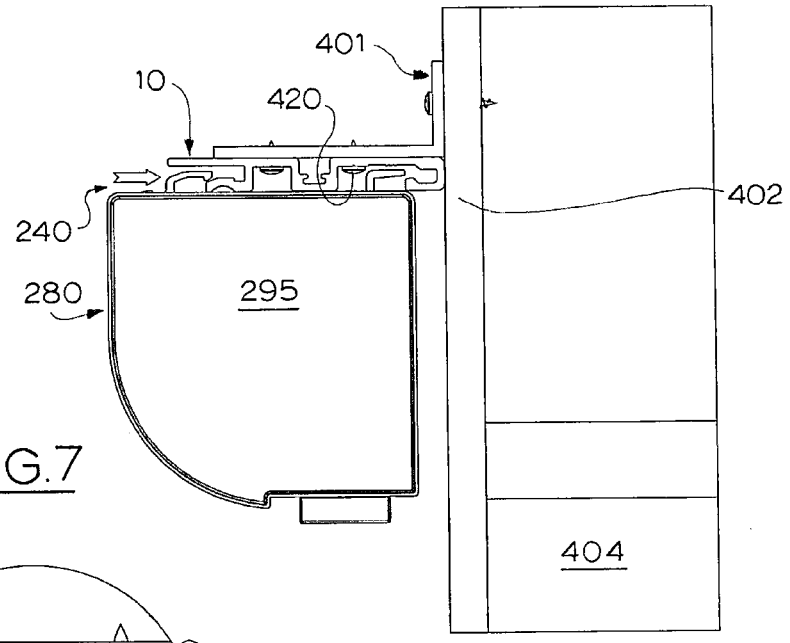
FIGS. 7 and 8 show further steps in installing the mounting arrangement of FIG. 4.
Figure 8:
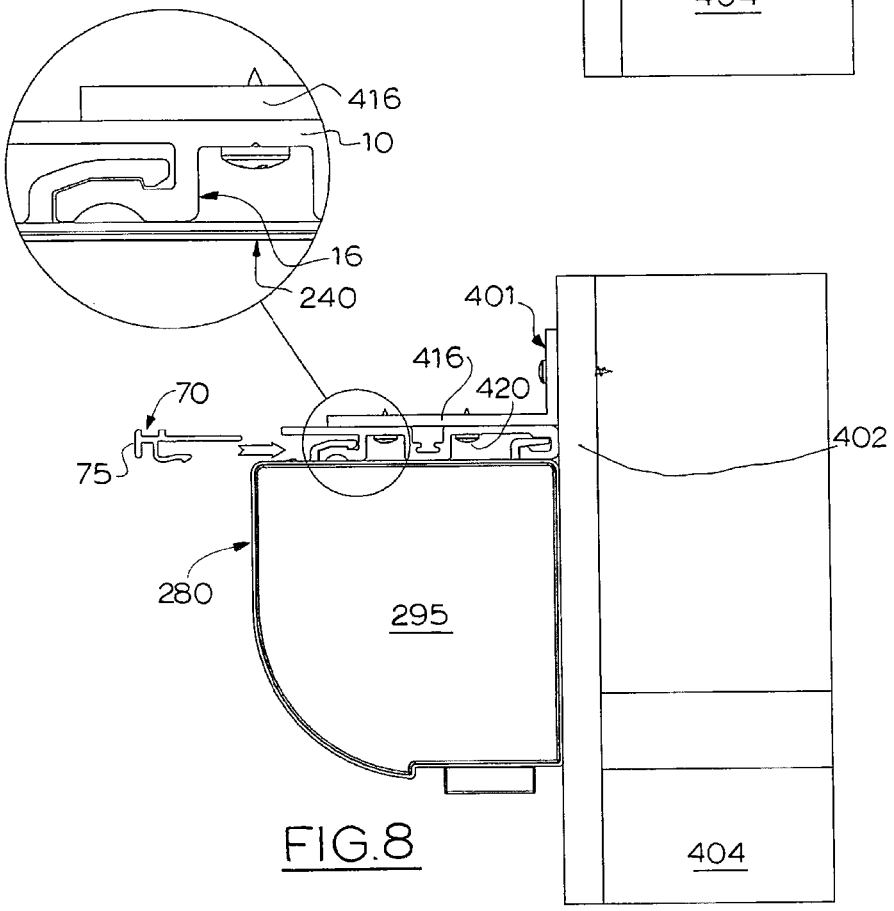

As illustrated in FIGS. 7 and 8 the housing 280 can be mounted to the first member 10 in a manner that will be appreciated from the foregoing description. After insertion of the securing member 70, the housing 280 is securely mounted to the bracket 401, again as described above.

As illustrated in FIGS. 2(*c*) and 4, the side portion 75 provides a generally rectangular facing panel which is generally contiguous with the front wall portion 291A of the housing, which assists in providing an attractive appearance.

Figure 9:
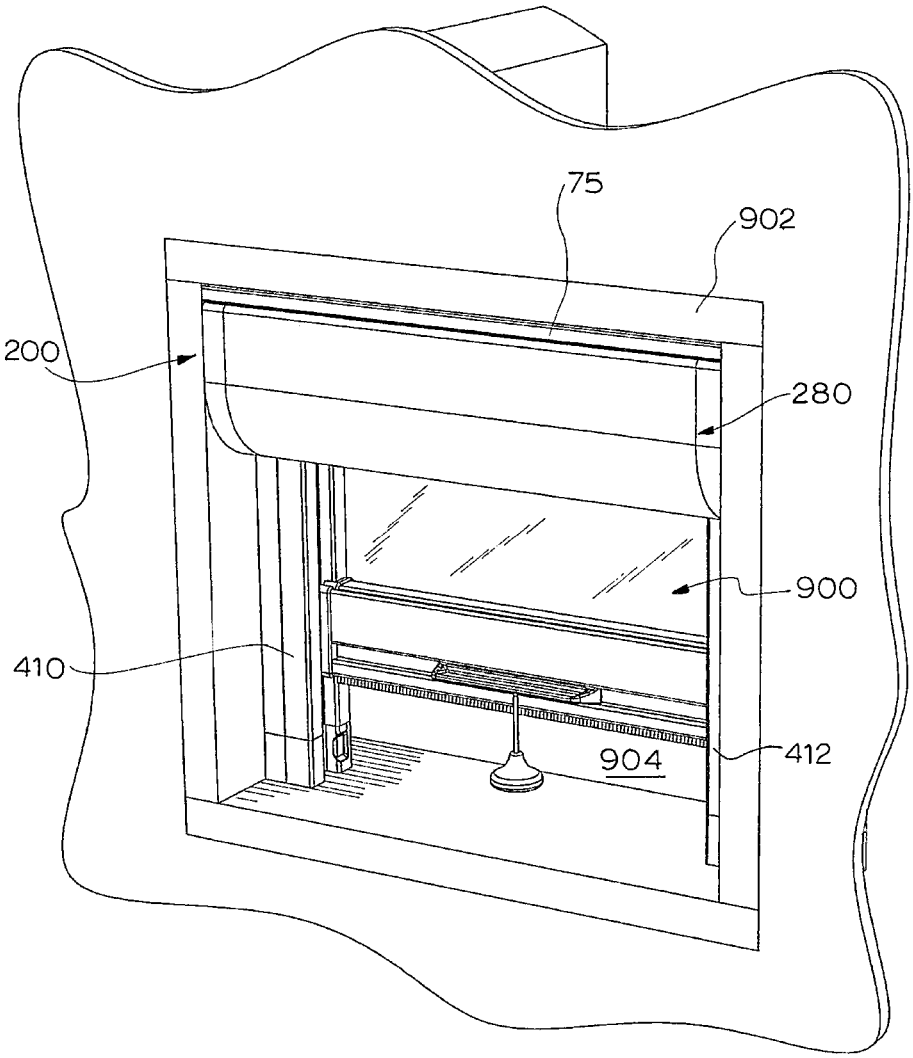
FIG. 9 is an illustration of the mounting arrangement and housing for a roller of FIG. 4 mounted to a horizontal part of a wall forming a window opening.

FIG. 9 shows a perspective view of the apparatus 200 of FIGS. 2(*a*) to 3 in use as part of a blind assembly 900, mounted in an alternative position, relative to a window opening 904, to that shown in FIG. 4.

In this embodiment the apparatus 200 is mounted within the window opening 904. The blind assembly 900 may be substantially the same as the blind assembly 400 except for its position and any consequent adjustment of dimensions.

In this embodiment the first member 10 is mounted to a horizontal wall part 902 which partially defines the window opening.

Figure 10:
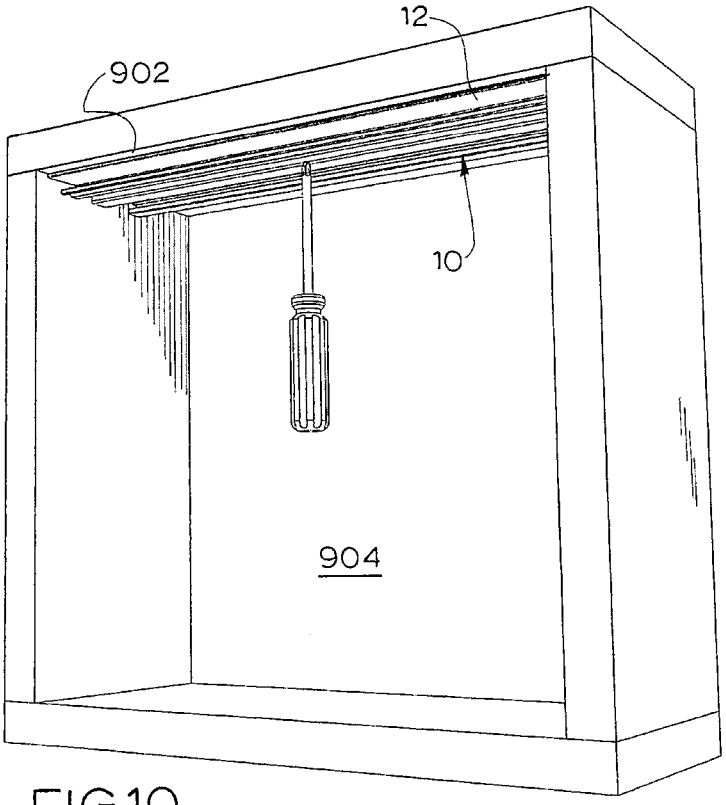
FIGS. 10 and 11 are respectively perspective and side views illustrating attachment of a first component of the mounting arrangement of FIG. 9 to the horizontal part of the wall in the window opening of FIG. 9.
Figure 11:
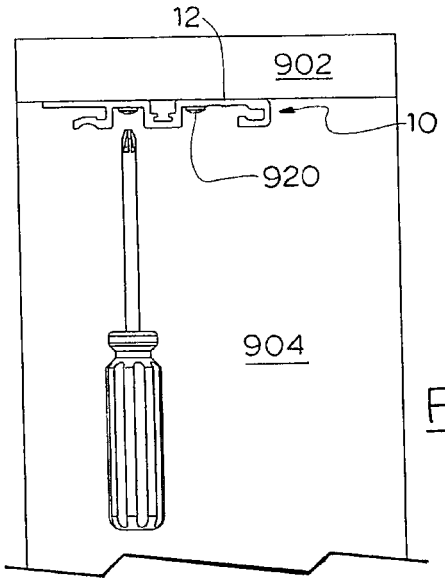

As illustrated in FIGS. 10 and 11, the first member 10 is attached to the wall part 902, for example using fasteners which extend through the top side wall 12 and into the wall part 902. The fasteners may be suitable screws 920. In this embodiment no separate bracket is required (although a bracket could be used if desired).

After the first member 10 is mounted on the wall portion 902 the housing 280 can be mounted to the first member as described above.

It will be appreciated that much of the disclosure provided above is applicable to the embodiment of FIGS. 9 to 11, and does not need to be repeated.

In the embodiment of FIG. 9 the guide tracks 410, 412 are provided within the window opening 904. This is in contrast to the embodiment of FIGS. 4 to 8, in which the guide tracks 410, 412 are mounted to the wall adjacent the window opening 402. It will be appreciated that the guide tracks 410, 412 are secured to the appropriate wall or wall portion, for example by use of screws or other fasteners (not shown).

It should be appreciated that many variations are possible, and that the above description of preferred embodiments is intended to illustrate preferred implementations in accordance with the present disclosure to teach the addressee how to implement the invention.

For example, in the described embodiments the first and second members each provide first and second projections, and thereby provide two laterally spaced apart regions where the first member supports the second member. However, more or fewer such regions could be provided. In one variation a single such support region could be provided (although it will be appreciated that provision of two or more laterally spaced apart support regions assists in spreading load and resisting torque that may be applied to the second member). In another variation three or more such support regions could be provided, for example (but not limited to) by providing further projections across the width of the members. In a variation the further projections may correspond in form and/or function to the first and second projections (of each of the first and second members) described above.

Further, in the described embodiments the projections of the first member are snuggly fitted between the projections of the second member and some other part of the second member in use. However, it will be appreciated that in alternative embodiments this does not need to be the case. For example, embodiments may be provided in which there is considerable play between the first and second members.

In some embodiments insertion of an insertion portion may constrain the position of the second member relative to the first member so that some or substantially all of such play is eliminated when the insertion portion is inserted.

For example, in a variation of the described embodiments the second side (or underside) of the first member need not be engaged by the second member. For example the spacing portions 44, 54 may be longer than in the illustrated embodiments so that the engaging portion and the catch member can freely move above the corresponding supporting surfaces and then be moved (or allowed to move) away from the first (top) side wall portion, prior to insertion of the insertion part.

Also, in the described embodiments a restraining part is provided in the form of a catch portion which is resiliently moveable relative to (most of) the rest of the second member, and the insertion part may be regarded as restricting or preventing disengagement of the first and second members by acting directly on the catch part. In other envisaged embodiments, the restraining part may take the form of some other constrainable part corresponding broadly in function to the catch portion, and for example may be substantially rigidly attached to the rest of the second member, so that movement of this part towards or away from the first side of the first member is effected by moving all of (or at least a substantial part of) the second member towards or away from the first side of the first member. In such an embodiment the insertion part need not act directly upon the restraining part, but can restrict movement of the restraining part towards the first side of the first member by restricting movement of some other part of the second member towards the first side of the first member.

Many other variations are possible.

As mentioned above, an advantage of the described embodiments is that the first member 10, second member 40 and securing member 70 are all formed as elongate members which each have substantially uniform transverse cross sectional shape (apart from apertures which may be used to accept fasteners therethrough, and which may be drilled as needed, on site). Thus the members may be cut to any desired length, for example a suitable length to extend across a window, from supplied standard stock. Further, because the members are each substantially uniform in transverse cross sectional shape, longitudinal alignment of the members is not required, as might be the case if the members were provided with complementary catch portions or the like, or discrete securing members, spaced periodically along their lengths.

Provision of the members 10, 40, 70 as elongate members with substantially uniform transverse cross sectional shape can further ease installation of the mounting arrangement. For example, the installer can select the positions along the length of the first member 10 where apertures are provided in order to fasten, e.g. screw, the first member 10 to a support. It would be potentially more difficult if an installer had to work with fixed pre-formed points of attachment, bearing in mind that mounting arrangements, for example for blinds (including insect screens), may be required to be of very different lengths, corresponding to windows or other openings to be screened being of very different widths.

Further, the first member 10, second member 40 and securing member 70 may be in the form of extrusions, for example of aluminium, which allows simple and economical manufacture.

Further, the described embodiments can provide a mounting arrangement which allows secure mounting of a second member relative to a first member, but which allows the second member to be demounted from (and, if desired, subsequently remounted to) the first member without requiring operation of a multiplicity of fasteners, such as screws or the like. The second member is secured, or 'locked', to the first member by a single elongate securing member which can be manually inserted and removed.

Avoiding the repeated removal and replacement of fasteners (screws or the like) can assist in maintaining the integrity of the connection between the fasteners and the support surface, and thus help maintain the strength of the connection of the mounting assembly to the support surface despite repeated mounting and demounting. It also avoids the possibility of fasteners being lost between removal and replacement, and the possibility of an insufficient number of fasteners being used for remounting as a consequence of such loss.

The securing member (and in particular the side portion 75 thereof) is easily visible, and it is therefore easy to see whether it has been correctly inserted to properly secure the second member.

Another advantage of the embodiments described above with reference to the drawings is that the heads of the fasteners, e.g. screws, that are used to fix the first member to the support surface are hidden from view once the second member is mounted in place and secured by the securing member. They are internally received within the structure provided and cannot be seen. This can vastly improve the aesthetics of the product (compared to arrangements in which fastener heads are visible) and the described embodiments can provide a neat and clean visible surface free from the unsightly appearance of the heads of screws or the like.

In the embodiments described above, a first member 10, e.g. in the form of a strip of aluminium extrusion, is mounted in position up against a mounting surface (provided, for example, by a wall part 902, as described above). The first member is a light member that can be easily held in position while it is attached to the mounting surface, and can be positioned so that it extends horizontally with fine tolerance (if necessary using shims or washers, as required between the first member and the mounting surface).

Thus an advantage of the embodiments described above with reference to the drawings is that initial installation a roller housing is considerably easier than with prior mounting arrangements in which the housing is attached directly to the wall surface. In such prior mounting arrangements the housing is held up against the mounting surface and the housing is then fixed to the mounting surface by fastening elements such as screws. The housing is relatively bulky and heavy compared to the first member 10 and is therefore more difficult to hold in position while the fasteners are inserted into the mounting surface. Further in many applications such as a mounting arrangement for a blind or screen, the housing needs to be accurately mounted on the mounting surface. It needs to be mounted in a horizontally extending orientation with a fine tolerance. This is necessary for a screen or blind to hang vertically in a blind opening.

The improved aesthetics described above are also of particular benefit in the mounting of a roller housing to a support, especially as roller housings (or, in the absence of such housings, the rollers themselves) for screens are often easily visible in domestic and workplace environments where aesthetics is a substantial consideration.

Another advantage of the embodiments described above in the specific description is that they can facilitate access to an interior of a housing for maintenance of the apparatus inside the housing, e.g. a roller and screen material rolled onto the roller. With the described embodiments the securing member is removed and then the second member is moved transverse to the first member to detach it therefrom. Thus the housing can be easily moved to a position and location convenient for maintenance. In contrast, a housing that is attached directly to a mounting surface by a plurality of fasteners either requires relatively time-consuming demounting and remounting, or requires access to the interior of the housing to be performed while the housing is in situ in its in-use location, which may be inconvenient or even potentially hazardous, for example if the in-use location is at considerable. In an embodiment the housing may also be opened in situ if desired, after removal of the securing member (e.g. 271) which can be arranged to prevent opening of the housing when the securing member is in position. It will be appreciated that this can be accomplished quickly and effectively by a user having knowledge of the system and does not require the use of a screw driver.

Modifications and improvements may be incorporated without departing from the scope of the invention described herein.

The invention claimed is:

1. A mounting arrangement comprising:

a first component which has a length, and a cross-section transverse to the length which is uniform along the whole length, and which is adapted to be attached to a support; and a second component which has a length, and a cross-section transverse to the length which is uniform along the whole length, and which is adapted to be supported by the first component;

wherein the first component has a first side which is distal from the second component when the second component is supported by the first component, and the first component comprises a supporting portion spaced apart from the first side;

wherein the second component comprises at least one engagement portion for engagement with the supporting portion of the first component;

wherein the mounting arrangement comprises a restraining part moveable between a restraining configuration for restraining disengagement of the engagement portion from the supporting portion, and a release configuration for allowing disengagement of the engagement portion from the supporting portion; and wherein the mounting arrangement further comprises a securing component comprising a securing part which has a length, and a cross-section transverse to the length which is uniform along the whole length, and which is insertable between at least part of the second component and the first side of the first component to restrict movement of the restraining part and thereby restrict disengagement of the engagement portion from the supporting portion.

2. A mounting arrangement as claimed in claim 1, wherein the restraining part is moveable between a restraining configuration further from the first side of the first component, for restraining disengagement of the engagement portion from the supporting portion, and a release configuration closer to the first side of the first component for allowing disengagement of the engagement portion from the supporting portion.

3. A mounting arrangement as claimed in claim 2, wherein the securing part is insertable between at least part of the second component and the first side of the first component to restrict movement of the restraining part towards the first side of the first component.

4. A mounting arrangement as claimed in claim 1, wherein the first and second components are configured so that the engagement portion is engageable with the supporting portion by movement of at least part of the engagement portion away from the first side of the first component, and disengageable from the supporting portion by movement of at least part of the engagement portion towards the first side of the first component.

5. A mounting arrangement as claimed in claim 1, wherein the first component comprises a supporting projection which provides the supporting portion, the supporting projection comprises a spacing region which spaces the supporting portion from at least part of a remainder of the first component, the second component comprises an engagement projection which provides the engagement portion, and the engagement projection comprises a spacing region which spaces the engagement portion from at least part of a remainder of the second component.

6. A mounting arrangement as claimed in claim 1, wherein the engagement portion provides an engagement surface, facing generally towards the first side of the first component, wherein the securing part is insertable to substantially prevent movement of the engagement portion towards the first side of the first component.

7. A mounting arrangement as claimed in claim 1, wherein the first component has a second side which is proximal to the second component when the second component is supported by the first component, the securing part is insertable between the second side of the first component and the first side of the first component to restrict movement of the restraining part and/or engagement portion towards the first side of the first component.

8. A mounting arrangement as claimed in claim 1, wherein the securing part is insertable between the restraining part and the first side of the first component to restrict movement of the engagement portion and/or the restraining part towards the first side of the first component.

9. A mounting arrangement as claimed in claim 1, wherein the securing part is insertable between the engagement portion and the first side of the first component to restrict movement of the engagement portion and/or the restraining part towards the first side of the first component.

10. A mounting arrangement as claimed in claim 1, wherein the first component comprises an extrusion; the second component comprises an extrusion; and the securing component comprises an extrusion.

11. A mounting arrangement as claimed in claim 1, wherein the securing part is insertable between at least part of the second component and the first side of the first component by a substantially lateral movement of the securing component relative to at least one of the first and second components, and the first and second components are moveable between a configuration in which the engagement portion does not engage the supporting portion, and a configuration in which the engagement portion engages and is supported by the supporting portion, by substantially lateral movement of the second component relative to the first component, and the restraining part is moveable between the restraining configuration and the release configuration by substantially lateral movement of the second component relative to the first component.

12. A mounting arrangement as claimed in claim 1, wherein there is provided at least one guide surface on the first component and at least one guide surface on the second component which guides movement of the restraining part when the second component is moved laterally relative to the first component, wherein the guide surfaces guide movement of the restraining part towards and/or away from the first side of the first component when the second component is moved laterally relative to the first component, and at least one guide surface guides movement of the restraining part in a direction which includes a component perpendicular to a length and a width of the first component when the second component is moved laterally relative to the first component.

13. A mounting arrangement as claimed in claim 1, wherein the second component is adapted to support a housing for a roller, and comprises either: at least part of a bracket, or at least part of a housing for a roller.

14. A mounting arrangement comprising:

a first component which has a length, and a cross-section transverse to the length which is uniform along the whole length, and which is adapted to be attached to a support; and a second component which has a length, and a cross-section transverse to the length which is uniform along the whole length, and which is adapted to be supported by the first component;

wherein the first component has a first side which is distal from the second component when the second component is supported by the first component, and a second side which is proximal to the second component when the second component is supported by the first component, and the first component comprises a supporting portion spaced apart from the first side;

wherein the second component comprises at least one engagement portion for engagement with the supporting portion of the first component;

wherein the first and second components are configured so that the engagement portion is moveable into a working position in which it is engaged with the supporting portion, by movement of at least part of the second component substantially linearly in a first direction so that a first part of the engagement portion is engaged with the supporting portion and a further part of the second component is engaged with a retaining portion of the mounting arrangement which prevents or restricts movement of the engagement portion towards the first side of the first component; and wherein the mounting arrangement comprises a securing arrangement for restricting or preventing movement of the engagement portion in a second direction opposite to the first direction.

15. A mounting arrangement as claimed in claim 14, wherein the movement of at least part of the second component substantially linearly in a first direction comprises movement of at least part of the second component substantially in a lateral direction relative to the first component.

16. A mounting arrangement as claimed in claim 15, wherein the movement of at least part of the second component substantially linearly in a first direction comprises movement of substantially all of the second component substantially in a lateral direction relative to the first component.

17. A mounting arrangement as claimed in claim 14, wherein the mounting arrangement further comprises a securing component comprising a securing part which has a length, and a substantially uniform transverse cross-section transverse to the length which is uniform along the whole length.

18. A mounting arrangement comprising:

a first component which has a length, and a cross-section transverse to the length which is uniform along the whole length, and which is adapted to be attached to a support; and a second component which has a length, and a cross-section transverse to the length which is uniform along the whole length, and which is adapted to be supported by the first component;

wherein the first component comprises a supporting portion adapted to be spaced apart from the support;

wherein the second component comprises at least one engagement portion for engagement with the supporting portion of the first component;

wherein the first and second components are configured so that the engagement portion is engageable with the supporting portion by movement of at least part of the engagement portion away from the support, and disengageable from the supporting portion by movement of at least part of the engagement portion towards the support; and wherein the mounting arrangement further comprises securing component comprising a securing part which has a length, and a cross-section transverse to the length which is uniform along the whole length, and which is insertable between at least part of the second component and the support to restrict movement of the engagement portion towards the support and thereby restrict disengagement of the engagement portion from the supporting portion.

19. A mounting arrangement as claimed in claim 18, wherein the first component comprises a supporting projection which provides the supporting portion, the supporting projection comprises a spacing region which spaces the supporting portion from at least part of a remainder of the first component, the second component comprises an engagement projection which provides the engagement portion, and the engagement projection comprises a spacing region which spaces the engagement portion from at least part of a remainder of the second component.

20. A mounting arrangement as claimed in claim 18, wherein at least one of the supporting projection and the engagement projection provides at least one shaped guide region to guide engagement of the supporting projection and the engagement projection, the at least one guide region comprises a beveled region provided adjacent to or as part of the supporting portion or the engagement portion, the supporting portion provides a supporting surface having a first side, and the supporting projection provides a guide region at the first side of the supporting surface.

* * * * *